United States Patent [19]

Maciejczak

[11] Patent Number: 4,552,244

[45] Date of Patent: Nov. 12, 1985

[54] SAFETY SUPPORT AND RESCUE CLAMP

[76] Inventor: Robert A. Maciejczak, 640 W. . Devon, Chicago, Ill. 60631

[21] Appl. No.: 534,755

[22] Filed: Sep. 22, 1983

[51] Int. Cl.[4] ..... A62B 1/00

[52] U.S. Cl. ..... 182/82; 182/3; 182/134

[58] Field of Search ..... 182/82, 4, 36, 37, 133–136, 182/112, 3, 6–9, 192, 8; 248/246

[56] References Cited

U.S. PATENT DOCUMENTS

| | | | |
|---|---|---|---|
| 4,156,515 | 5/1979 | Mochly | 248/246 |
| 4,223,863 | 9/1980 | Berkman | 248/246 |
| 4,310,070 | 1/1982 | Mastroglannis | 182/221 |

FOREIGN PATENT DOCUMENTS

| | | | |
|---|---|---|---|
| 2385881 | 12/1978 | France | 182/8 |
| 577106 | 6/1976 | Switzerland | 182/8 |

*Primary Examiner*—Reinaldo P. Machado
*Assistant Examiner*—Alvin Chin-Shue
*Attorney, Agent, or Firm*—Michael G. Berkman

[57] ABSTRACT

A safety support and rescue clamp for use on building structures for supporting personnel and equipment on wall faces of buildings. The clamp is characterized in that it is receivable into an elongated vertical, channel-like slotted track of the type affixed in the wall of a high-rise building. A pivotal pawl of the clamp bridges between side walls of the slot and locks rotationally within the track to serve as positive anchor means for overcoming a weight-derived, downwardly-directed force vector impressed upon a lever attached to the pawl and extending outwardly from the track.

15 Claims, 8 Drawing Figures

SAFETY SUPPORT AND RESCUE CLAMP

BACKGROUND OF THE INVENTION

The present invention relates to a safety and rescue clamp. More particularly, the invention is directed to a safety support and rescue clamp for use on building structures for supporting personnel and equipment on wall faces of buildings.

In recent years it has become a widespread practice to erect high-rise buildings in which the outer walls are substantially entirely of glass except for the structural framing members and support girders and channels. In many buildings of this type, the window panels do not open, and the windows are washed on the outside utilizing personnel-supporting scaffolding, the latter being carried by cables and running along guide slots in vertically extending channels permanently secured in as part of the face of the building wall itself.

It has now been recognized that there is a need for a means by which a work station or platform can be secured to the face of the walls of such building structures. Such building platforms should be securable other than by means of suspension from guy-wires or cables.

It is also contemplated that there would be important advantages and benefits in being able to utilized a clamping element for anchoring or supporting personnel on the outer face of buildings of the type described. Such a capability could be very helpful in the event of accidents or emergencies such as fires. In such situations it might be desirable to have access and entry into the building from an outer face or wall, in order to facilitate the rescue of people who might otherwise be trapped.

It is to the solution of the type of problems posed that the present invention is directed.

BRIEF DESCRIPTION OF THE INVENTION

The present invention is directed to a weight-supporting safety and rescue clamp adapted for use on high-rise buildings of the type having vertically extending channels generally rectangular in transverse section and formed with co-lineal slots opening outwardly. In its preferred embodiment, the clamp includes an elongated pawl alignable with and insertable into the channel through the slot and pivotal grippingly to engage interior opposed walls of the channel at selectable positions therealong to support a weight or a weight-derived force vector impressed on the pawl. The clamp is releasable by pulling up on a lever connected to and displaced outwardly from the pawl itself.

It is an important feature of the present invention that there is attached to the internally insertable pawl an axlelike rod by means of which the pawl is rotatably manipulated to bridge and grippingly to engage the sidewalls of the elongated track at opposed lateral interior faces thereof and mechanically to lock the clamp against sliding displacement downwardly within the track.

A related feature of the invention is that the clamp assembly includes a lever connected to and projecting generally normally of the axle for imparting rotational movement to the axle and for concurrently pivotally displacing the pawl means carried thereby in response to pull or to pressure applied to the lever and about the axle.

Yet another feature of the clamp of the invention is that it includes a crank rod parallelling the axle and extending from an end of the lever for shifting the lever arcuately and for rotating the axle and the axle-connected pawl.

Still another feature of the clamping assemnbly is that it includes a slot-like guide defining an opening for receiving a strap-like web therethrough, the guide constituting a generally L-shaped extension of the crank rod and having an arm which is co-planar with the crank rod and opposed to the lever, and a second arm co-planar with the first arm and joined thereto and projecting normally thereof and opposed to and generally parallelling the crank rod.

A related cooperating element of one embodiment of the assembly of the invention is a strap-like web which is looped on the crank rod and passes through the guide, the web being adapted for supporting weight forces pressing downwardly therealong and for transmitting such forces to effect rotation of the pawl, thereby releasably to lock the pawl within the track.

Still another feature of the clamp is that the weight-supporting web serves as well as means for lifting the crank rod and for rotating the pawl, thereby to disengage the pawl from the sidewalls of the track and to free the pawl from locked engagement within the building-anchored channel.

Yet another feature of the clamp assembly of the invention is that it includes a yoke constituting a mechanical stop for limiting rotational movement of the pawl within the track and in a plane generally parallelling sidewalls of the track or channel.

A related feature of the yoke is that it defines a pair of spaced, essentially parallel arms including a rear arm and a front arm and a connecting shaft bridging therebetween and joining corresponding lower ends of the arms to one another, the rear arm constituting a clamp-stabilizing abutment for contacting and bearing against a rearwall of the track interiorly thereof to limit rotation of the pawl in a vertical plane generally perpendicular to a plane of locking, functional rotation of the pawl.

It is a feature of the invention that in one embodiment of the yoke there is provided an abutment bar constituting means for limiting the inward displacement of the pawl into the slotted track, the abutment bar being fastened and depending from the yoke.

Other and further features, advantages and objects of the invention will be evident from a reading of the following description considered in conjunction with the drawings.

DESCRIPTION OF PREFERRED EMBODIMENTS

The aims and objects of the invention are realized through the use of a weight-supporting safety and rescue clamp assembly of a simple, yet highly effective design. The clamp is uniquely adapted for use on building structures including high-rise buildings of the type having channels extending vertically at laterally space positions along the face of the building, the channels being of a form which is generally rectangular in transverse section and defining lineally coextensive slots opening outwardly. In a preferred embodiment of the invention, the clamp includes an elongated plate-like pawl which is insertable directly into the channel through the slot and is pivotal within the slot so as grippingly to engage the interior opposed sidewalls of the channel at selectable, vertical positions along the length of the channel. As inserted and rotated, the pawl establishes weight-supporting locking engagement with the channel. Subsequently, the clamp is readily releasable by lifting a lever coupled to the pawl through an axle, and thus reversely pivoting, and freeing the pawl.

Figure 1:
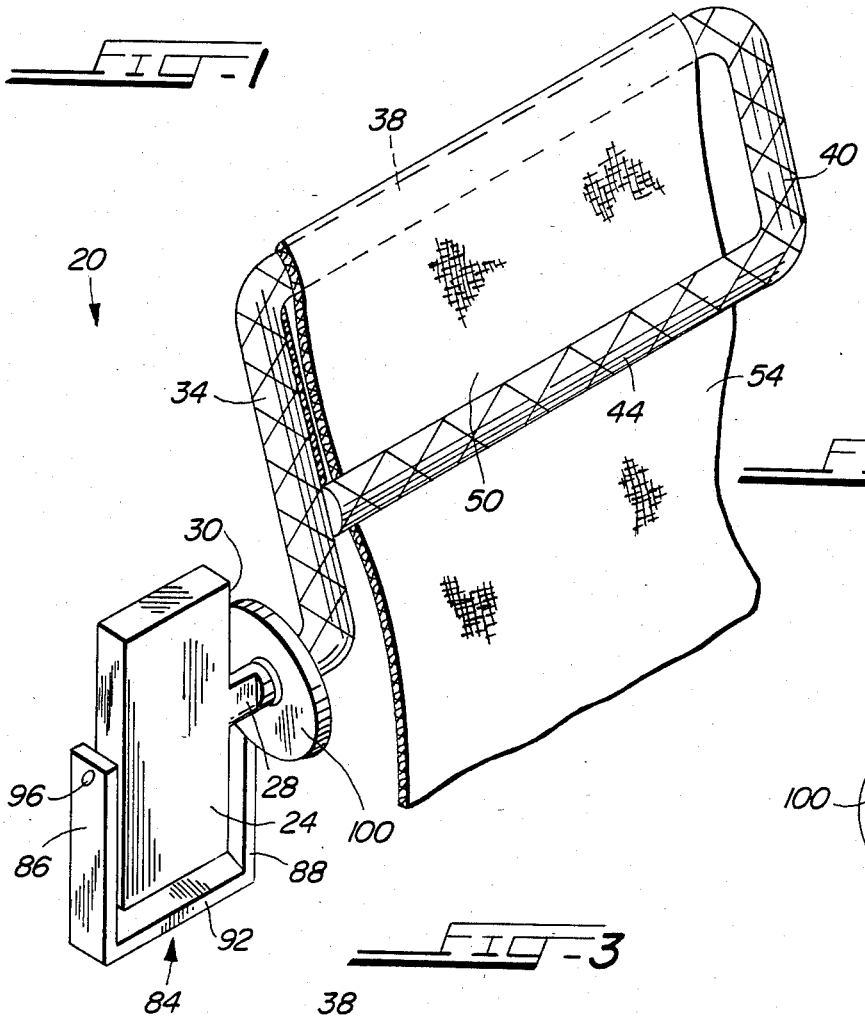
FIG. 1 is a perspective view of a clamp according to the invention, embodying the features thereof.
Figure 2:
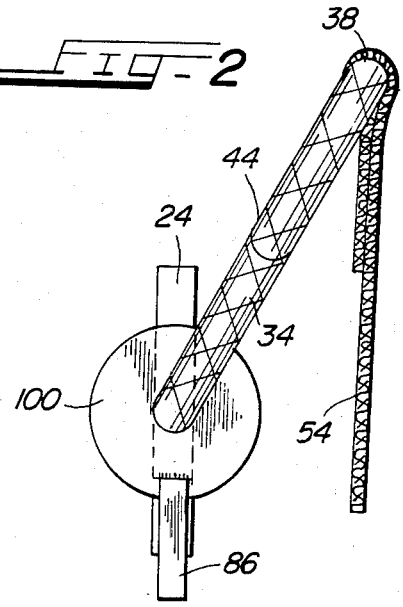
FIG. 2 is a front-elevational view of the clamp of FIG. 1.
Figure 3:
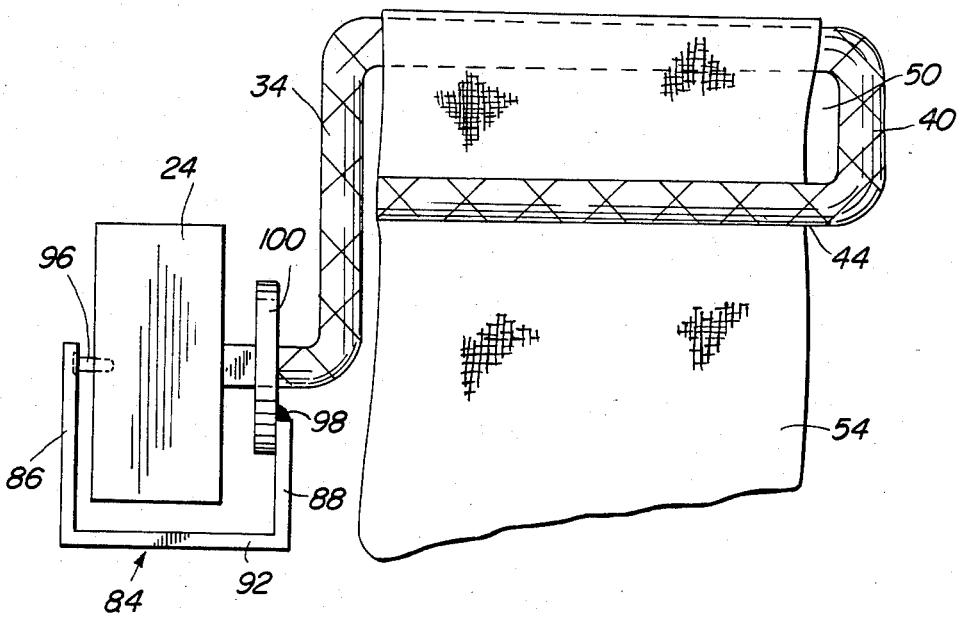
FIG. 3 is a side-elevational view of the embodiment of the invention shown in FIG. 1.

Referring now to the drawings, and particularly to FIGS. 1, 2, and 3, there is shown, for purposes of illustration and not in any limiting sense, one preferred embodiment of the invention. The safety support and rescue clamp 20 illustrated includes a pawl 24 to which is connected an axle 28 extending from an edge face 30 of the pawl 24 and generally in the plane of the pawl. A lever 34 is affixed to the end of the axle 28 and extends normally thereof. In the specific preferred embodiment of the invention depicted in FIGS. 1–3, a crank rod 38 is connected to the lever 34, to extend therefrom. An L-shape extension including a shorter arm 40 parallelling the lever 34 and a longer arm 44 parallelling the crank arm 38 completes the frame of a generally rectangular opening 50. The latter provides either a handhold or may be used for receiving a web or strap 54 therethrough. In the embodiment of invention depicted in FIGS. 1–3, the strap or web 54 is looped or otherwise secured to the crank arm 38.

The strap 54 serves a dual function. In its downwardly directed or depending mode, as shown in FIG. 1, the strap may constitute a loop through which the user of the device may insert a foot and thereby support himself. Alternatively, the strap may be directed upwardly and be available as a means by which the crank rod 38 is lifted and thereby effects a release of the pawl 30 from its locked engagement within a channel of a building structure in which the pawl 24 is engaged—all as further described herebelow.

Figure 4:
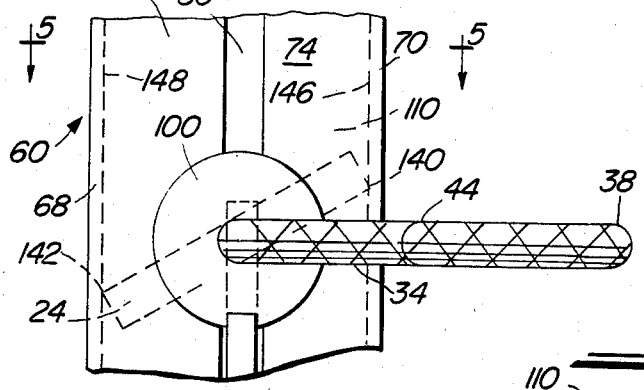
FIG. 4 front view showing the clamp of the invention inserted into a slotted channel and indicating schematically the operational mode of the clamp with the locking pawl in position.
Figure 5:
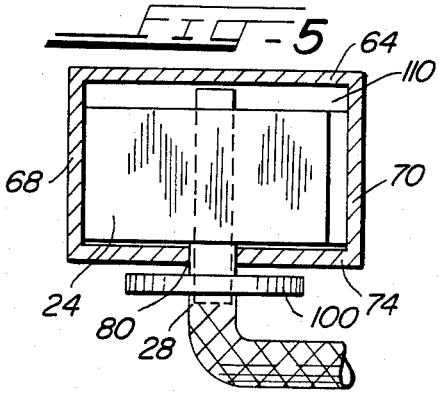
FIG. 5 is a cross-sectional view taken substantially on the lines 5—5 of FIG. 4.

In FIG. 4 there is shown a segmental section of an elongate, generally vertically extending channel-like slotted track 60 of the general type in which the clamping device 20 of the invention finds utility. The track 60 includes a rearwall 64 and a pair of opposed sidewalls 68 and 70 and a front wall 74. The front wall 74 is formed with a vertically extending opening 80 through which the pawl 24 of the clamp 20 of the invention is insertably received (FIGS. 4 and 5).

In the preferred embodiment of the invention illustrated, the clamp is enhanced with a yoke 84, generally U-shaped in configuration. The yoke 84 is pivotal with respect to the pawl 24 and includes a pair of front and rear sidearms 86 and 88 bridged by a base 92. The forward arm 86 of the yoke 84 is pivotally secured to the pawl 24 through a hinge pin 96. The opposite, rear arm 88 of the yoke 84 is welded 98 to, or otherwise secured to, an abutment disc or plate 100 which, in the preferred embodiment of the invention illustrated, is rotatably mounted or hubbed on the axle 28 extending from the pawl 24.

The abutment plate 100 limits the extent of insertion of the pawl 24 forwardly into the cavity 110 of the slotted channel 60, the plate 100 abutting as a limit, the rearwardly presented slotted wall 74 of the channel 60.

The generally U-shaped yoke 84 is normally in a depending mode with respect to the axle 28 of the clamp assembly 20. As so disposed, the forwardly presented arm 86 of the yoke 84 serves as a limit or mechanical stop for restricting the rotational movement or shifting of the pawl within the track structure 60 and in a plane generally parallelling the sidewalls 68 and 70 of the track 60, and generally perpendicular to a plane of functional rotation of the pawl 24 itself.

Figure 6:
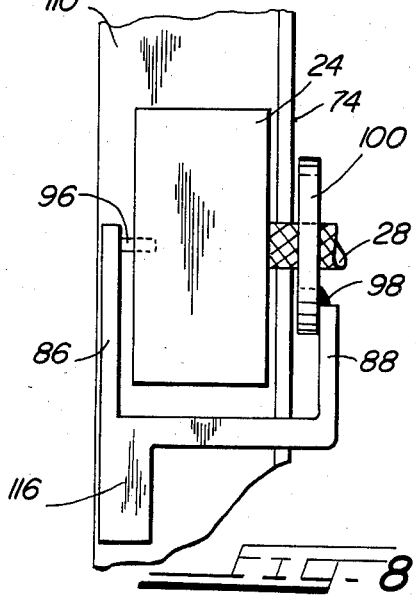
FIG. 6 is a cross-sectional view taken substantially on the lines 6—6 of FIG. 3.

FIG. 6 indicates schematically the manner in which the pawl 24 and related structure are oriented within the cavity 110 of the slotted channel 60. In this specific embodiment of the invention there is provided, in conjunction with the yoke 84, an extension bar 116 fastened to and projecting generally downwardly from the inwardly presented arm 86 of the yoke assembly 84. The extension bar 116 serves further to limit objectionable and rotational and distortional displacement of the clamping assembly in a plane generally normally of the plane of functional operation of the pawl 24.

Figure 7:
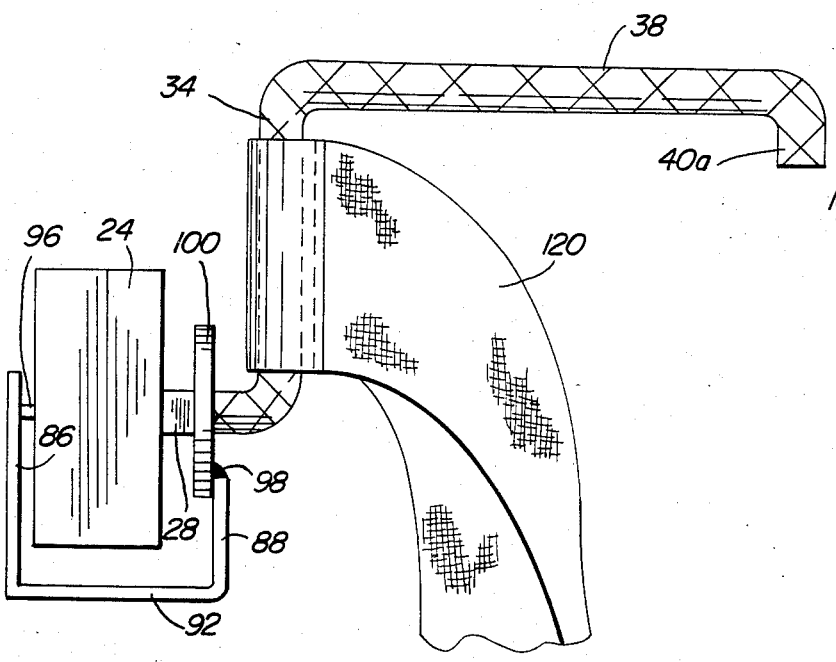
FIG. 7 is a side-elevational view of a second embodiment of the clamp of the invention showing a modified crank arrangement.

The structure illustrated in FIG. 7 is similar to that of FIG. 1 except that a web or strap 120 is fastened to the crank rod 34, and a portion of the guide-forming bars 40 and 44 of FIG. 1 have been eliminated. There remains only a stub or stop **40*a* attached to and projecting normally from the level 38**.

Figure 8:
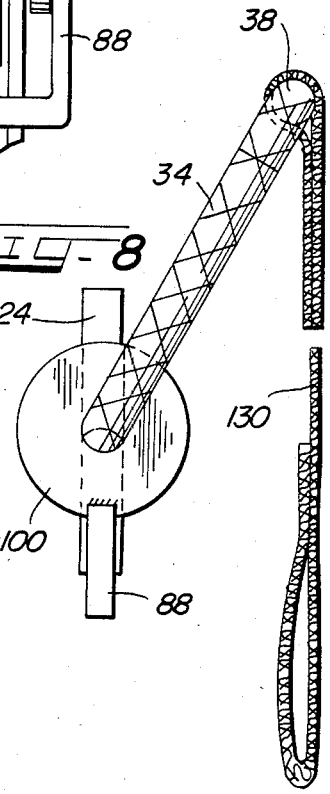
FIG. 8 is a front-elevational view of the clamp of FIG. 7, with a load-support strap fastened in place on the crank bar.

In FIG. 8, the structure depicted is similar to that of FIG. 7 with the exception that a web 130 is fastened to the lever 38.

It is believed that, in the light of the foregoing detailed description, the mode of operation of the clamp of the invention will be apparent. In use, the pawl, together with the yoke 84 carried thereby, is aligned with and inserted through the slot 80 in the channel track 60. With the pawl 24 within the cavity 110 of the channel 60, the axle 28 and the attached pawl 24 are rotated clockwise (FIG. 4) so that the lower right corner edge 140 and the upper left corner edge 142 of the pawl 24 abut respectively the interior faces 146 and 148 of respective channel sidewalls 70 and 68. In a preferred embodiment of the invention the pawl 24 of a specially hardened metallic composition and the corner edges 140 and 142 are sharpened or otherwise finished so as bitingly and firmly mechanically to engage and grip the opposed walls 168 and 170 of the channel 60. Thus, there is established a firm and weight supporting interengagement. As indicated schematically in FIG. 4, with the pawl 24 in its positively engaged position, the attached bar assembly including the lever and associated components 34, 38, 40, and 44 extend in a generally horizontal plane. The arrangement described enables the clamp to support very substantial downwardly stressed vertical forces, and weights well in excess of 1000 pounds.

The dimensions and other parameters of the clamp of the invention are not critical. Rather, they are dictated by and readily adaptable to the specific dimensional characteristics of the channel in which the particular clamp is to be used. In the specific example illustrated, the channel has an internal lateral expanse of about 2 inches, and the channel is about $1\frac{3}{4}$ inches in depth. Accordingly, the pawl for use with this channel structure is preferaoly about $2\frac{1}{2}$ inches long, about 1 inch wide, and about 5/16 of an inch in thickness. The bar-like components of the clamp have a diameter of about $\frac{5}{8}$ of an inch. When the forwardly presented face of the abutment plate 100 is essentially in contact with the slotted wall 74 of the channel 60, the forwardly presented arm 86 of the yoke 84 is adjacent and is substantially in contact with the far wall 64 of the elongated channel 60, all as indicated schematically in FIG. 6.

When it is desired to remove the clamp 24 of the invention from the channel 60, or to raise the clamp or lower it within the channel, it is necessary merely to lift upwardly on the crank bar 34 (or any physical extension thereof) thereby to disengage the pawl 24 from its locked position. The pawl 24 is then realigned with the slot 80 in the channel 60 and may be withdrawn and recovered. Otherwise, it may be repositioned. In a preferred embodiment of the invention, the yoke assembly 84 is freely rotatable so that it remains at all times in alignment with the access opening 80 of the channel 60.

It will be appreciated that, in use of the clamp 20 of the invention, the web constitutes a convenient means by which ones foot may be inserted and supported as in a sling. Two or more clamps of the invention may be used simultaneously. Under these conditions, one's foot may be supported in the web, while one manually grips a second clamp 20 which is secured at a position elevated with respect to or above the foot-supporting clamp. With the arrangement described, it is quite feasible to raise, or to lower the clamps, successively, and thus traverse the wall of the building both upwardly and downwardly as may be required in any particular situation.

While preferred embodiments of the invention have been illustrated and described, other variations may be made utilizing the invention concepts herein disclosed. It is intended that all such variations be considered as within the scope of the invention as defined in the following claims.

What is claimed is:

1. A safety support and rescue clamp for use on building structures for supporting personnel and equipment on wall faces of a building structure, said clamp including a generally rectangular plate-like pawl means having opposed side edges, front and rear edge faces, for selectively and removably positionable within an elongate, generally vertically-extending channel-like slotted track supported on a building structure on a wall face thereof, the track having a pair of opposed parallel side walls, a rear wall, and a pair of slot-defining, spaced partial front walls, said pawl means being operable to lock within the track and constituting anchor means for overcoming a weight-derived force vector directed downwardly along the track, said pawl means being alignable with a slot formed in a forwardly presented face of the track and being insertable into the track through the slot formed therein, said pawl means being pivotally disposed within the track, and having an overall length which exceeds a distance between the opposed side walls of the track, said pawl means opposed side edges serving to bridge and grippingly to engage the side walls of the track at opposed lateral interior faces thereof and mechanically to lock said clamp against sliding displacement downwardly within the track, axle means for pivotally supporting and manipulating said pawl means, said axle means being joined to and extending rearwardly and normally from said rearwardly directed edge face of said pawl means, and in a plane generally paralleling a principal plane of said pawl means, and lever means connected to and projecting generally normally of said axle means for imparting rotational movement to said axle means and for, concurrently, pivotally displacing said pawl means carried thereby, in response to pressure applied to said lever means and about said axle means.

2. A clamp as set forth in claim 1 and further comprising web means for supporting weight carried by and depending from said clamp, and securement means fastening said web means to said lever means.

3. A clamp as set forth in claim 1 and further comprising web means for lifting said lever means to rotate said pawl means attached thereto, and to release and to disengage said pawl means from said side walls of said track to free said pawl means from locked engagement within said track, and securement means fastening said web means to said lever means.

4. A clamp is set forth in claim 1 and further comprising crank rod means parallelling said axle means and extending from an end of said lever means for shifting said lever means arcuately and for rotating said axle means and said pawl means attached thereto.

5. A clamp as set forth in claim 4 and further comprising guide means defining a guide for receiving a strap-like web therethrough, said guide means including an L-shaped extension of said crank rod means, said extension having a first arm co-planar with and joined to and projecting normally of said crank to means and opposing said lever means, and a second arm co-planar with said first arm and joined thereto and projecting normally thereof and opposed to and generally parallelling said crank rod means.

6. A clamp as set forth in claim 5 and further comprising a strap-like web looped on said crank rod means and passing through said guide, said web being adapted for impressing weight forces downwardly therealong and for transmitting such forces to effect rotation of said pawl means, thereby releasably to lock said pawl means within the track.

7. A clamp as set forth in claim 6 wherein said web comprises means for lifting said crank rod means and for rotating said pawl means attached thereto, thereby to disengage said pawl means from said side walls of said track and to free said pawl means from locked engagement therewithin.

8. A clamp as set forth in claim 4 and further comprising a strap-like web and means attaching said web to said crank rod means.

9. A clamp as set forth in claim 8 wherein said web comprises means for impressing weight forces thereon and for transmitting such forces to effect rotation of said pawl means, thereby releasably to lock said pawl means within the track.

10. A clamp as set forth in claim 8 wherein said web comprises means for lifting said crank rod means and for rotating said pawl means attached thereto, thereby to disengage said pawl means from said side walls of the track and to free said pawl means from locked engagement therewithin.

11. A clamp as set forth in claim 1 and further comprising generally U-shaped yoke means, said yoke means comprising mechanical stop means for limiting rotational movement of said pawl means within the track and in a vertical plane generally paralleling the side walls of the track, means rotatively supporting said yoke means on said axle means, said yoke means defining a pair of spaced, essentially parallel arms including a rear arm and a front arm and a connecting shaft bridging therebetween and joining corresponding ends of said arms to one another, said front arm constituting means for contacting and bearing against a front wall of the track, interiorly thereof, to limit rotation of said pawl means in a plane generally perpendicular to a plane of functional rotation of said pawl means.

12. A clamp as set forth in claim 11 and further comprising abutment means pivotally supported on said axle means rearwardly of a point of attachment of said axle means to said pawl means, said abutment means constituting means for limiting inware displacement of said pawl means into the slotted track.

13. A clamp as set forth in claim 12 and further comprising means fastening said yoke means to said abutment means for pivotable movement therewith on said axle means.

14. The structure as set forth in claim 9 wherein said contacting means comprises a clamp-stabilizing extension bar fastened to and projecting downwardly from said front arm of said yoke.

15. The method of utilizing a safety support and rescue clamp for supporting personnel and equipment on an outer wall of a building structure of the type including a vertically extending channel-like slotted track having opposed side walls and affixed on a wall face of the buidling structure, said method comprising aligning a generally rectangular plate-like pawl of a clamp having opposed side edges, front and rear edge faces, with the slot of the the track, inserting the pawl into the track through an outwardly presented opening defining the slot of the track, rotating the pawl within the channel of the track by means of an axle joined to and extending rearwardly and normally from a rearwardly directed edge face of the pawl and projecting outwardly from the track, bringing opposed side edges of the pawl to bridge laterally across within the channel and grippingly to engage opposed side walls of the track interiorly thereof, physically to secure the clamp against sliding displacement downwardly within the channel of the track, impressing weight-derived force on a lever connected to and projecting generally normally of the axle to impart rotational torque to the axle and mechanically to transfer the torque to the pawl, stressingly maintaining the pawl in pressing and locking engagement with the walls of the track at a selectable position therealong, opposing a weight-derived downwardly-directed force vector, and supporting a weight coupled to the pawl.

* * * * *